US007439910B2

(12) United States Patent
Lee

(10) Patent No.: US 7,439,910 B2
(45) Date of Patent: Oct. 21, 2008

(54) THREE-DIMENSIONAL ANTENNA STRUCTURE

(75) Inventor: Gwo-Yun Lee, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 11/309,198

(22) Filed: Jul. 13, 2006

(65) Prior Publication Data

US 2007/0126639 A1 Jun. 7, 2007

(30) Foreign Application Priority Data

Dec. 7, 2005 (TW) ..... 94143092 A

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/702, 343/700 MS

See application file for complete search history.

(56) References Cited

U.S. PATENT DOCUMENTS

2004/0090375 A1 * 5/2004 Dai et al. ..... 343/700 MS

* cited by examiner

*Primary Examiner*—Hoang V Nguyen
*Assistant Examiner*—Robert Karacsony
(74) *Attorney, Agent, or Firm*—Jianq Chyun IP Office

(57) ABSTRACT

A three-dimensional antenna structure suitable for being built in an electronic device includes a vertical patch, an annular patch and a ground patch. The vertical patch is suitable for generating a vertical current. One end of the annular patch is connected to the vertical patch, and the annular patch surrounds one side of the vertical patch for generating an annular current. An omni-directional radiation field is generated by the annular current and the vertical current. The annular patch has a feed point for electrically connecting to a signal source. One end of the ground patch is connected to the vertical patch. A distance exists between the end of the annular patch and the end of the ground patch. The other end of the ground patch has a shorting point next to the feed point and is suitable for electrically connecting to a ground.

13 Claims, 3 Drawing Sheets

THREE-DIMENSIONAL ANTENNA STRUCTURE

CROSS-REFERENCE TO RELATED APPLICATION

This application claims the priority benefit of Taiwan application serial no. 94143092, filed on Dec. 7, 2005. All disclosure of the Taiwan application is incorporated herein by reference.

BACKGROUND OF THE INVENTION

1. Field of the Invention

The present invention generally relates to an antenna structure, and more particularly, to a three-dimensional antenna structure built in an electronic device.

2. Description of Related Art

In keeping pace with progress in telecommunication technology, application of the telecommunication technology for hi-tech products has been increasing and related telecommunication products have become diversified. In recent years, the consumer functional requirements for telecommunication products have become increasingly higher; therefore, telecommunication products with various designs and functions are continuously brought to market, the computer network products with wireless networks are in demand. Since the antenna design affects telecommunication quality of telecommunication products, it is the key factor of telecommunication products.

Generally speaking, antennas have a higher height for achieving the purpose of omni-direction transmissions, such that external antennas are adopted. External antennas comprise monopole antennas, helix antennas and printed dipole antennas. However, in order to reduce the height of an antenna or hide the antenna, the internal antenna usually is a planarized design. Internal antennas comprise microstrip antennas and planar inverted F antennas (PIFA).

FIG. 1A is a three-dimensional diagram showing a conventional microstrip antenna. Referring to FIG. 1A, the microstrip antenna 100 comprises a radiating patch 110, a feed coaxial cable 120 and a ground plane 130. One end of the inner core conductor of the feed coaxial cable 120 is connected to a feed point 112 of the radiating patch 110, such that the radiating patch 110 is connected to a signal source through the feed coaxial cable 120. Further, one end of the outer shielding conductor of the feed coaxial cable 120 is connected to the ground plane 130.

FIG. 1B is a radiation pattern of the microstrip shown in FIG. 1A. Referring to FIGS. 1A and 1B, during signal transmissions, a better signal transmission area is restricted to some specific area since the microstrip 100 has a broadside radiation pattern. More specifically, a better signal transmission area is right above the microstrip antenna 100, and a poor signal transmission area is around the microstrip antenna 100.

SUMMARY OF THE INVENTION

To achieve the above and other objects, the present invention is directed to a three-dimensional antenna structure for providing better communications and stable communication quality.

As embodied and broadly described herein, the present invention provides a three-dimensional antenna structure suitable for being built in an electronic device. The three-dimensional antenna structure comprises a vertical patch, an annular patch and a ground patch. The vertical patch is suitable for generating a vertical current. Besides, a first end of the annular patch is connected to the vertical patch, and the annular patch surrounds one side of the vertical patch for generating an annular current. An omni-directional radiation field is generated by the annular current and the vertical current. The annular patch has a feed point suitable for electrically connecting to a signal source. Additionally, a first end of the ground patch is connected to the vertical patch, and a first distance exists between the first end of the annular patch and the first end of the ground patch. A second end of the ground patch opposite to the first end thereof has a shorting point next to the feed point and is suitable for electrically connecting to a ground.

According to an embodiment of the present invention, a second distance exists between a second end of the annular patch away from the first end thereof and the vertical patch.

According to an embodiment of the present invention, the second end of the annular patch away from the first end thereof has a broadened part, and a width of the broadened part is larger than a width of the other part of the annular patch.

According to an embodiment of the present invention, the vertical patch, the annular patch and the ground patch are fabricated from the same material metal sheet.

According to an embodiment of the present invention, the three-dimensional antenna structure further comprises a fixing patch. One side of the fixing patch is connected to the vertical patch and is suitable for fixing on a carrier.

According to an embodiment of the present invention, the fixing patch is further electrically connected to the ground.

According to an embodiment of the present invention, the vertical patch, the annular patch, the ground patch and the fixing patch are fabricated from the same material metal sheet.

According to an embodiment of the present invention, the feed point is connected to one end of an inner core conductor of a coaxial cable for electrically connecting to a signal source, and the shorting point is connected to one end of an outer shielding conductor surrounding the inner core conductor of the coaxial cable for electrically connecting to a ground.

According to an embodiment of the present invention, a third distance exists between the feed point and the shorting point, and the third distance is substantially equal to a length of the inner core conductor exposed from the outer shielding conductor, such that an equivalent resistance between the feed point and the shorting point is substantially equal to a predetermined resistance.

According to an embodiment of the present invention, the predetermined resistance is 50Ω.

The three-dimensional antenna structure utilizes the vertical current and the annular current produced by the vertical patch and the annular patch, respectively, to generate the omni-directional radiation field, such that the antenna structure may provide better communications and stable communication quality.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
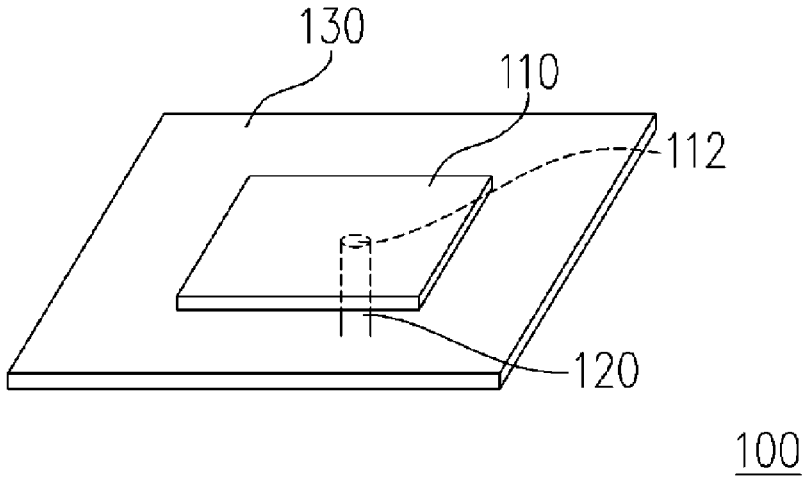
FIG. 1A(PRIOR ART)
FIG. 1A is a schematic diagram showing a conventional microstrip antenna.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
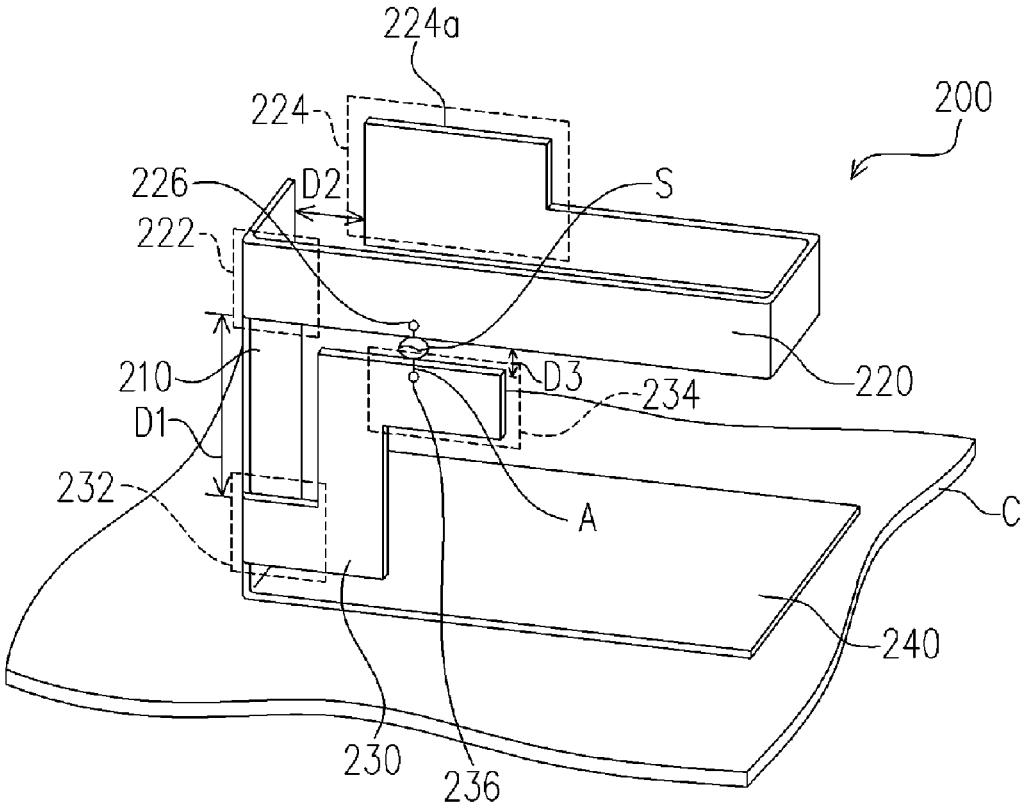
FIG. 2A is a three-dimensional diagram showing a three-dimensional antenna structure according to one embodiment of the present invention.

FIG. 2A is a three-dimensional diagram showing a three-dimensional antenna structure according to one embodiment of the present invention. Referring to FIG. 2A, the three-dimensional antenna structure 200 of this embodiment is suitable for being built in an electronic device for receiving and transmitting signals. The three-dimensional antenna structure 200 comprises a vertical patch 210, an annular patch 220 and a ground patch 230.

The vertical patch 210 is suitable for generating a vertical current. In this embodiment, the vertical patch 210 may be fixed on a carrier C, such as a circuit board inside the electronic device. Besides, the vertical patch 210 may be fixed on the carrier C by welding, attaching or inserting the vertical patch 210 on the carrier C.

The annular patch 220 surrounds one side of the vertical patch 210. A first end 222 of the annular patch 220 is connected to the vertical patch 210, and a second end 224 of the annular patch 220 is far away from the portion where the annular patch 220 is connected to the first end 222 of the vertical patch 210. A second distance D2 exists between the second end 224 and the vertical patch 210. Additionally, the annular patch 220 has a feed point 226 suitable for electrically connecting to a signal source S. In this embodiment, the second end 224 of the annular patch 220 further includes a broadened part 224*a*, and the width of the broadened part 224*a* is larger than the width of the other part of the annular patch 220.

A first end 232 of the ground patch 230 is connected to the vertical patch 210, and a first distance D1 exists between the first end 222 of the annular patch 220 connected to the vertical patch 210 and the first end 232 of the ground patch 230 connected to the vertical patch 210. Further, a second end 234 of the ground patch 230 has a shorting point 236, which is next to the feed point 226 and suitable for electrically connecting to a ground.

Figure 3:
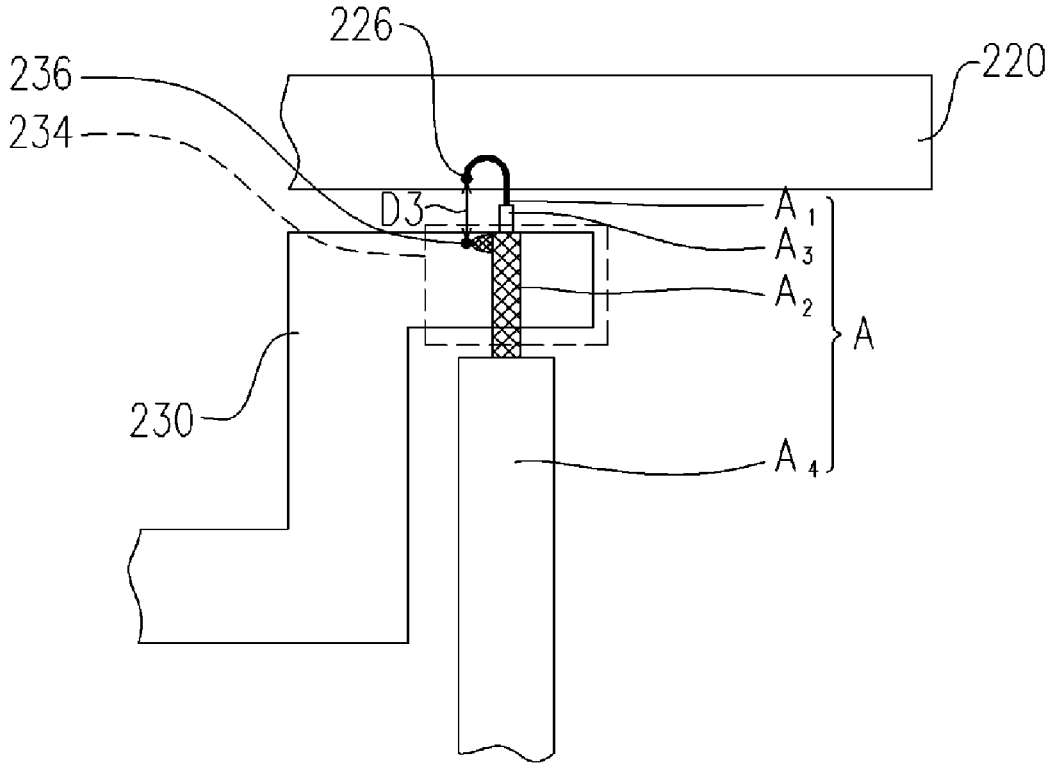
FIG. 3 is a schematic diagram showing the feed point and the shorting point connected to the coaxial cable.

In this embodiment, the feed point 226 and the shorting point 236 may be electrically connected to the signal source S and the ground through a coaxial cable A (as shown in FIG. 3), respectively. A third distance D3 exists between the feed point 226 and the shorting point 236.

FIG. 3 is a schematic diagram showing the feed point and the shorting point connected to the coaxial cable. Please refer to FIGS. 2A and 3, the coaxial cable A comprises an inner core conductor A1, an outer shielding conductor A2, an insulating layer A3 and a protection layer A4. The inner core conductor A1 is surrounded by the outer shielding conductor A2; the insulating layer A3 is arranged between the inner core conductor A1 and the outer shielding conductor A2; the outer shielding conductor A2 is covered by the protection layer A4.

The feed point 226 of the annular patch 220 is connected to one end of the inner core conductor A1 for electrically connecting to the signal source S. Besides, the shorting point 236 of the ground patch 220 is connected to one end of the outer shielding conductor A2 for electrically connecting to the ground.

It should be noted that a portion of the inner core conductor A1 is exposed from the outer shielding conductor A2, and the length of the inner core conductor A1 exposed from the outer shielding conductor A2 is substantially equal to the third distance D3, such that an equivalent resistance between the feed point 226 and the shorting point 236 is substantially equal to a predetermined resistance. In this embodiment, the predetermined resistance is 50Ω, a general specification for signal transmission.

Figure 1B:
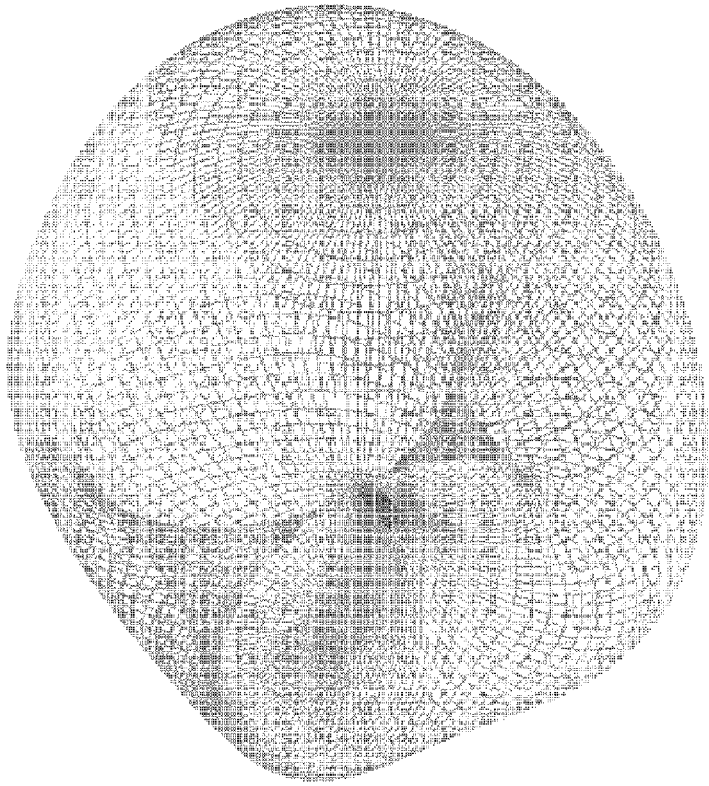
FIG. 1B(PRIOR ART)
FIG. 1B is a radiation pattern of the microstrip antenna shown in FIG. 1A.
Figure 2B:
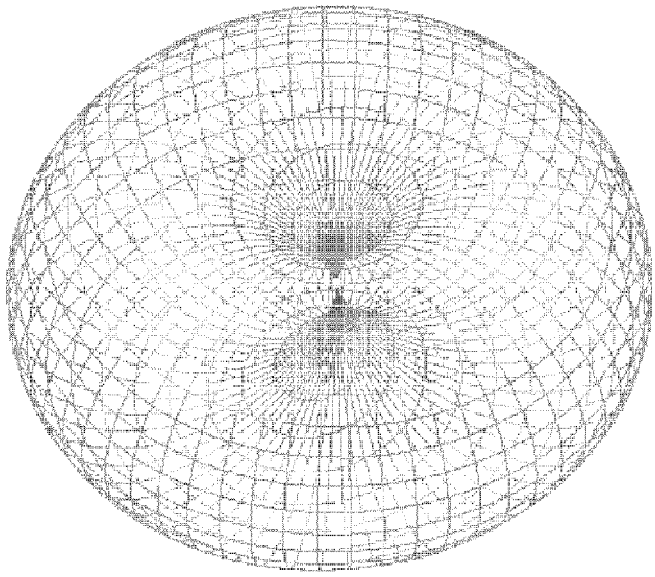
FIG. 2B is a radiation pattern of the three-dimensional antenna structure shown in FIG. 2A.

FIG. 2B is a radiation pattern of the three-dimensional antenna structure shown in FIG. 2A. Please refer to FIGS. 2A and 2B, when the three-dimensional antenna structure 200 operates, a horizontal annular current is generated from the annular patch 220, and an omni-directional radiation field (as shown in FIG. 2B) is generated by the annular current and the vertical current generated from the vertical patch 210. Compared with the vertical radiation field (as shown in FIG. 1B) generated by the conventional microstrip antenna structure, the omni-directional radiation field generated from the three-dimensional antenna structure 200 provides a broader signal receiving and transmitting area. Accordingly, the three-dimensional antenna structure 200 of this embodiment provides better communications and stable communication quality.

In this embodiment, the radiation field of the antenna structure 200 can be adjusted according to the variation of the first distance D1 between the first end 222 of the annular patch 220 and the first end 232 of the ground patch 230, the variation of the second distance D2 between the second end 224 and the vertical patch 210, or the variation of the width of the broadened part 224*a* of the second end 224, to attain better signal transmissions. Besides, the radiation field of the three-dimensional antenna structure 200 can be adjusted by shifting the feed point 226 and the shorting point 236 horizontally. Furthermore, the signal transmission frequency of the three-dimensional antenna structure 200 can be adjusted according to the variation of the length of the annular patch 220.

In this embodiment, the vertical patch 210, the annular patch 220 and the ground patch 230 may be fabricated from the same metal sheet. It means that the vertical patch 210, the annular patch 220 and the ground patch 230 may be integrally formed, and there is no need to join the vertical patch 210, the annular patch 220 and the ground patch 230 together by welding, screwing or attaching. Therefore, the fabrication cost of the three-dimensional antenna structure 200 can be reduced.

Please refer to FIG. 2A again, to firmly fix the three-dimensional antenna structure 200 on the carrier C, the three-dimensional antenna 200 may further include a fixing patch 240, wherein one side of the fixing patch 240 is connected to the vertical patch 210. The fixing patch 240, the vertical patch 210, the annular patch 220 and the ground patch 230 may be fabricated from the same metal sheet. Therefore, the three-dimensional antenna structure 200 may be firmly fixed on the carrier C through the fixing patch 240. In this embodiment, the fixing patch 240 may be fixed on the carrier C by welding, attaching or screwing. When the fixing patch 240 is electrically connected to the ground, the fixing patch 240 may serve as an assistant ground end of the three-dimensional antenna structure 200.

In summary, the three-dimensional antenna structure of the present invention utilizes the vertical current generated from the vertical patch and the horizontal and annular current generated from the annular patch to form the omni-directional radiation field for providing a broader signal transmission area. Therefore, the three-dimensional antenna structure has better signal transmissions and stable signal transmission quality.

Besides, when the three-dimensional antenna structure of the present invention is built in an electronic device, there is no need to connect the ground patch of the three-dimensional antenna structure with the ground of the electronic device, and therefore the arrangement of the three-dimensional antenna structure within the electronic device can be adjusted flexibly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A three-dimensional antenna structure, suitable for being built in an electronic device, the three-dimensional antenna structure comprising:

a vertical patch, for generating a vertical current, the vertical patch having a first end and second end;

an annular patch being transverse to the vertical patch and extending from the first end of the vertical patch, wherein a first end of the annular patch is directly connected to the first end of the vertical patch, the annular patch surrounds one side of the vertical patch for generating an annular current, an omni-directional radiation field is formed by the annular current and the vertical current, and the annular patch has a feed point suitable for electrically connecting to a signal source; and a ground patch, wherein a first end of the ground patch is directly connected to the second end of the vertical patch, a first distance along the vertical patch exists between the first end of the annular patch and the first end of the ground patch, and a second end of the ground patch opposite to the first end thereof has a shorting point next to the feed point and is suitable for electrically connecting to a ground.

2. The three-dimensional antenna structure according to claim 1, wherein a second distance horizontally exists between a second end of the annular patch away from the first end thereof and the vertical patch.

3. The three-dimensional antenna structure according to claim 2, wherein the second end of the annular patch away from the first end thereof has a broadened part, and a width of the broadened part is larger than a width of other parts of the annular patch.

4. The three-dimensional antenna structure according to claim 1, wherein the vertical patch, the annular patch and the ground patch are fabricated from the same material metal sheet.

5. The three-dimensional antenna structure according to claim 1, further comprising:

a fixing patch, wherein one side of the fixing patch is connected to the vertical patch and is suitable for fixing on a carrier.

6. The three-dimensional antenna structure according to claim 5, wherein the fixing patch is further electrically connected to the ground.

7. The three-dimensional antenna structure according to claim 5, wherein the vertical patch, the annular patch, the ground patch and the fixing patch are fabricated from the same material metal sheet.

8. The three-dimensional antenna structure according to claim 1, wherein the feed point is connected to one end of an inner core conductor of a coaxial cable for electrically connecting to a signal source, and the shorting point is connected to one end of an outer shielding conductor surrounding the inner core conductor of the coaxial cable for electrically connecting to a ground.

9. The three-dimensional antenna structure according to claim 8, wherein a third distance exists between the feed point and the shorting point, and the third distance is substantially equal to a length of the inner core conductor exposed from the outer shielding conductor, such that an equivalent resistance between the feed point and the shorting point is substantially equal to a predetermined resistance.

10. The three-dimensional antenna structure according to claim 9, wherein the predetermined resistance is 50Ω.

11. The three-dimensional antenna structure according to claim 2, wherein the annular patch extends in such a manner that the annular patch starts from the first end thereof, extends away from the vertical patch to a middle part, and then extends toward the vertical patch until the second end thereof.

12. The three-dimensional antenna structure according to claim 11, wherein the second end of the annular patch has a broadened part, and a width of the broadened part is larger than a width of other parts of the annular patch.

13. The three-dimensional antenna structure according to claim 1, wherein a plane surface of the ground patch is perpendicular to a plane surface of the vertical patch.

* * * * *